US012760530B2

(12) United States Patent
Merrick et al.

(10) Patent No.: US 12,760,530 B2
(45) Date of Patent: Oct. 13, 2026

(54) TAPERED ENGINEERED WOOD SHAKE WITH SHIPLAP EDGE

(71) Applicant: LOUISIANA-PACIFIC CORPORATION, Nashville, TN (US)

(72) Inventors: G. Paul Merrick, Gig Harbor, WA (US); Tommy R. Wyatt, Millers Creek, NC (US); Matthew Vrazel, Saint Peters, MO (US); David L. Stackhouse, N. Wilkesboro, NC (US); Eric Billings, Mcgrady, NC (US); James Whitley, Elkin, NC (US); Michael Combs, Millers Creek, NC (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 62 days.

(21) Appl. No.: 18/671,613

(22) Filed: May 22, 2024

(65) Prior Publication Data

US 2024/0392578 A1 Nov. 28, 2024

Related U.S. Application Data

(60) Provisional application No. 63/468,224, filed on May 22, 2023.

(51) Int. Cl.

| | |
|---|---|
| ***E04F 13/00*** | (2006.01) |
| ***E04F 13/08*** | (2006.01) |
| ***E04F 13/10*** | (2006.01) |

(52) U.S. Cl.

CPC ..... *E04F 13/10* (2013.01); *E04F 13/0864* (2013.01); *E04F 13/0889* (2013.01)

(58) Field of Classification Search

CPC ..... E04F 13/00; E04F 13/10; E04F 13/0864; E04F 13/0889

See application file for complete search history.

(56) References Cited

U.S. PATENT DOCUMENTS

| | | | | |
|---|---|---|---|---|
| 2,300,488 | A | 11/1942 | Cuno | |
| 4,437,274 | A | 3/1984 | Slocum et al. | |
| 4,665,675 | A * | 5/1987 | Kelly | E04F 13/0864 52/553 |
| 5,287,669 | A | 2/1994 | Hannah et al. | |
| D401,362 | S | 11/1998 | Bondoc et al. | |

(Continued)

OTHER PUBLICATIONS

International Search Report and Written Opinion, PCT/US24/30584, Lousiana-Pacific Corp. (international filing date May 22, 2024).

*Primary Examiner* — Chi Q Nguyen

(74) *Attorney, Agent, or Firm* — Wayne Edward Ramage; Baker Donelson

(57) ABSTRACT

A multi-layered, engineered-wood composite shake or shingle siding with weather-tight connections, edge-to-edge, between adjacent shakes or shingle siding planks or pieces. One or more water drainage grooves or channels may be machined or cut into the faces of underlap and/or overlap portions. A shake generally is delineated by a pressed-in groove or a machine-cut gap (e.g., "keyway"). For a shake near the end of a panel, a false keyway or partial keyway may be cut or machined into the end, thereby giving the appearance of a keyway when two ends are fitted together to form a lap joint. The number of shakes on a panel may vary.

19 Claims, 11 Drawing Sheets

(56) References Cited

U.S. PATENT DOCUMENTS

| | | | | |
|---|---|---|---|---|
| 6,526,717 | B2 * | 3/2003 | Waggoner | E04F 13/141 52/316 |
| 6,635,218 | B2 * | 10/2003 | King | B29C 51/24 264/555 |
| 9,915,073 | B1 * | 3/2018 | Hood | E04F 13/0864 |
| 10,011,996 | B1 * | 7/2018 | Sauerwein | E04F 13/0876 |
| 11,220,825 | B2 * | 1/2022 | Steffes | E04D 1/20 |
| 2007/0193150 | A1 * | 8/2007 | Carlson | E04F 13/007 52/302.1 |
| 2009/0100788 | A1 | 4/2009 | Gabbard et al. | |
| 2014/0202109 | A1 * | 7/2014 | Michalski | E04F 13/0875 428/156 |
| 2014/0234567 | A1 * | 8/2014 | Rule | E04F 13/0862 52/748.11 |
| 2015/0292214 | A1 * | 10/2015 | Maurer | E04F 13/185 52/592.1 |
| 2016/0208498 | A1 * | 7/2016 | Martin | E04F 13/0871 |
| 2019/0301160 | A1 | 10/2019 | Nash | |

* cited by examiner

BACK SIDE FACE OF SHAKE WITH OVERLAP EDGE

NOT TO SCALE

TAPERED ENGINEERED WOOD SHAKE WITH SHIPLAP EDGE

This application claims benefit of and priority to U.S. Provisional Application No. 63/468,224, filed May 22, 2023, 2024-05-22 which is incorporated herein in its entirety by specific reference for all purposes.

FIELD OF INVENTION

This invention relates to multi-layered, engineered-wood composite shake or shingle siding (which can be wood composite or wood-based planks or panels, such as oriented strand board (OSB), plywood, or other cellulose-based material). More specifically, this invention relates to multi-layered, engineered-wood composite tapered shake or shingle siding with weather-tight or weather-resistant connections, edge-to-edge, between adjacent shake or shingle siding planks or pieces.

BACKGROUND OF THE INVENTION

Classic solid wood shakes and shingles are usually made from cedar, and come in a variety of grades, lengths, and finishes. Some are treated to provide fungal and/or fire protection or resistance. Traditional wood shakes typically have a sawn smooth side and a textured side formed by mechanically splitting a section of log. Shingles typically are sawn (i.e., smooth) on both faces. Shakes typically are thicker and longer than shingles, While the term "shake" is generally associated with roof applications, and the term "shingle" is generally associated with wall applications, there are references in the industry to shingles being used with roof applications, and shakes being used for wall applications.

Engineered-wood shakes are provided in the form of planks, typically from 4-8 feet in length. Examples of engineered wood or wood-based composites include oriented strand board (OSB), wafer board, flake board, particle board as well as medium or density fiberboard (MDF or HDF). These wood-based composites are typically formed from a wood material combined with a thermosetting adhesive to bind the wood substrate together. In some processes, the adhesive is combined with other additives to impart additional properties to the wood composites. Additives can include fire retardants, fungicides/mildewcides, insecticides and water repellents. These ingredients can also be added separately from the adhesive, for example when this is more compatible with the manufacturing process. A significant advantage of strand, fiber and particle-based wood composites is that they have many of the properties of plywood and dimension lumber but can be made from a variety of lower grade wood species, smaller trees and waste from other wood product processing, and can be formed into panels in lengths and widths independent of size of the harvested timber.

One class of alternative products are multilayer oriented wood strand board products, particularly those with a targeted layer-to-layer oriented strand pattern, such as OSB. These oriented strand, multilayer composite wood panel products are composed of several layers of thin wood strands, which are wood particles having a length which is several times greater than their width. These strands are created from debarked round logs by placing the edge of a cutting knife parallel to a length of the log and then slicing thin strands from the log. The result is a strand in which the fiber elements are substantially parallel to the strand length.

These strands can then be oriented on the mat-forming line with the strands of the face layers predominantly oriented in a parallel to machine direction orientation and strands in the core layer oriented, generally, perpendicular to the face layers (e.g., cross-machine) direction.

In one common commercial process these layers are bonded together using natural or synthetic adhesive resins under heat and pressure to make the finished product. Oriented, multilayer wood strand boards of the above-described type can be produced with mechanical and physical properties comparable to those of commercial softwood plywood and are used interchangeably, such as for wall and roof sheathing. In certain applications and types of construction, these panels (and other construction materials) may be required by building codes to meet certain durability requirements, such as fire, wind and water resistance.

Oriented, multilayer wood strand boards of the above-described type, and examples of processes for pressing and production thereof, are described in detail in U.S. Pat. Nos. 3,164,511, 4,364,984, 5,435,976, 5,470,631, 5,525,394, 5,718,786, 6,461,743, and U.S. patent application Ser. No. 17/747,930, all of which are incorporated herein in their entireties by specific reference for all purposes.

SUMMARY OF INVENTION

In various exemplary embodiments, the present invention comprises a multi-layer, engineered-wood shake panel and/or board for use in exterior wall and/or roofing applications. As seen in the figures, the panel or board may be generally rectilinear in form. One end of the panel comprises the overlap portion of a shiplap joint, while the other end of the panel comprises the underlap portion of the shiplap joint. The shiplap joint is formed when panels are placed vertical end/edge to vertical end/edge, with the joint formed by the overlap end of one panel and the underlap end of an adjacent panel.

The shiplap joint effectively minimizes water intrusion through the seam between the ends of adjacent panels. The shiplap joint portions are machined into the shake panel during the manufacturing process in the factory or manufacturing facility. One or more water drainage grooves or channels also may be machined or cut into the faces of underlap and/or overlap portion. In several exemplary embodiments, as shown, the drainage grooves or channels are cut into at least the underlap portions.

A shake panel may comprise one or more "shakes" or "planks." A "shake" generally is delineated on either side by a pressed-in groove or a machine-cut gap (e.g., "keyway"). For a "shake" near the end of a panel, a "false keyway" or partial keyway may be cut or machined into the end, thereby giving the appearance of a "keyway" when two ends are fitted together to form a lap joint. The pressed-in groove may penetrate only the outer face of the panel, while the machine-cut gap may penetrate only the outer face, or may be cut through the entire thickness of the panel (i.e., through the outer and inner face of the panel). The number of shakes on a panel may vary. The width of shakes may be the same or may vary.

The keyways generally extend from the bottom edge of the panel orthogonally upward toward the top edge. The width of the keyway may vary based on the overall design and desired aesthetics. The length of the key generally extends for at least the portion of the lower part of the panel that will be exposed when the panels are installed on a wall (or roof). During installation, the upper part of the panels on a row are overlapped by the lower part of the panels in the row immediately above, thus hiding the upper part of each row of panels when installed.

The exposed end of the shake, commonly referred to as the drip edge, may vary in configuration (e.g., traditional square cut, rounded, triangular, angled, or the like), depending on the aesthetics and performance required. The bottom edge profile may be a butt-end (i.e., square, right-angle to the shake face), rounded, or angled. In several embodiments, the bottom edge may be angled to promote water droplet drop-off, run-off, or "shedding" from the panel, by preventing or reducing the ability of a water droplet to "cling" to the bottom drip edge, and from moving towards the back face of the panel through capillary or similar action.

While a panel may be of uniform thickness, in preferred embodiments the panel is tapered (i.e., wedge-like) in cross-section, with the top portion of the panel being thinner than the bottom portion. The taper may extend for some or all of the height of the panel (e.g., one-quarter, one-third, one-half, two-thirds, three-quarters, or the full height). The taper height and angle of cut would vary depending on the design and desired aesthetics.

The taper may be cut or machined into the panel during a secondary manufacturing process. The taper may be machined or cut onto the front face (i.e., outer or visible face) and/or the back face. In embodiments where a full-height taper is desired, the taper is machined on the back face. Similarly, in embodiments where the taper would be visible on the front face after installation, the taper preferably would be machined on the back face. The back face taper cut is important to preserve visible face surfaces that have aesthetic textures (e.g., wood grain), and also allows the installer to vary the overlap of shakes to achieve a desired aesthetic effect. The installer can also alternate the overlap to achieve a staggered look.

DETAILED DESCRIPTION OF EMBODIMENTS

In various exemplary embodiments, the present invention comprises a multi-layer, engineered-wood shake panel and/or board for use in exterior wall and/or roofing applications. One end of the panel 2 comprises the overlap portion 50 of a shiplap joint, while the other end of the panel comprises the underlap portion 60 of the shiplap joint. The shiplap joint is formed when panels are placed vertical edge to vertical edge, with the joint formed by the overlap end (or edge or vertical edge) of one panel and the underlap end/edge of an adjacent panel.

The shiplap joint effectively minimizes water intrusion through the seam between the ends of adjacent panels. The shiplap joint portions are machined into the shake panel during the manufacturing process in the factory or manufacturing facility. One or more water drainage grooves or channels also may be machined or cut into the faces of underlap and/or overlap portion. In several exemplary embodiments, as shown, the drainage grooves or channels are cut into at least the underlap portions.

Figure 1:
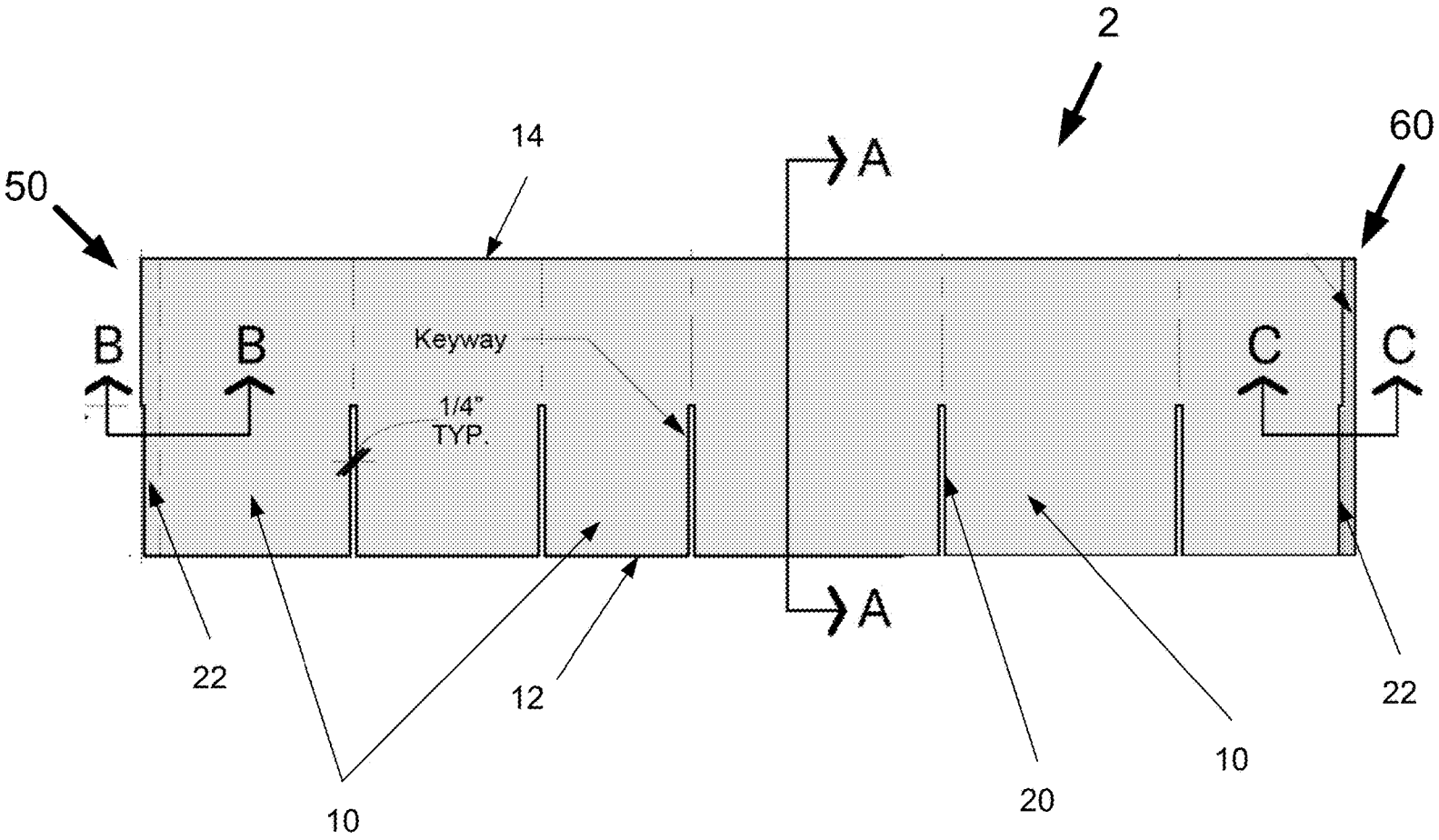
FIG. 1 shows a front view of the front or outer face of a 6-plank shake panel.
Figure 2:
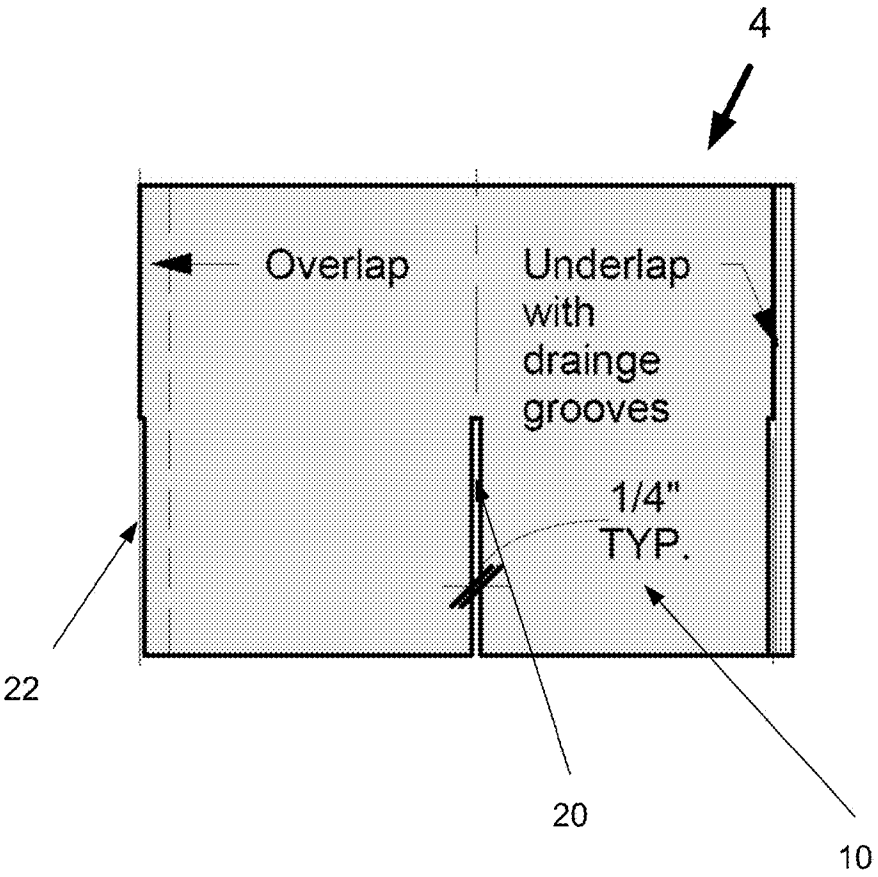
FIG. 2 shows a front view of the front face of a 2-plank shake panel.
Figure 3:
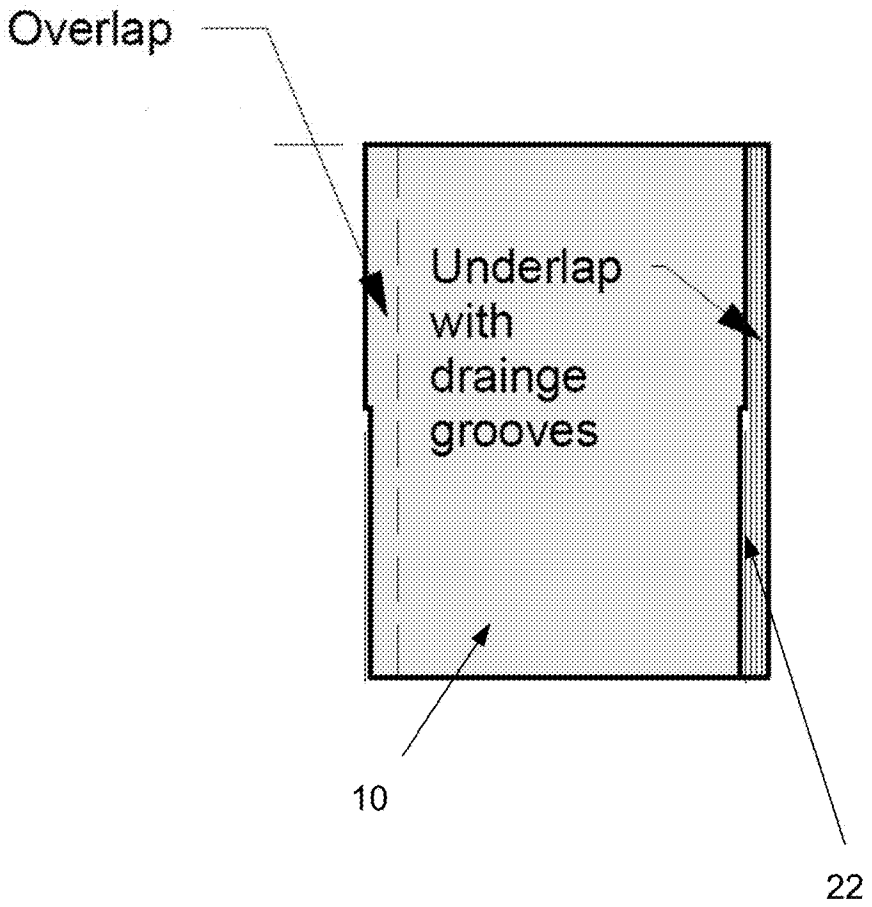
FIG. 3 shows a front view of the front face of a single-plank shake panel.

As seen in FIGS. 1-3, a shake panel 2 may comprise one or more "shakes" or "planks" 10. A "shake" 10 generally is delineated on either side by a pressed-in groove or a machine-cut gap (e.g., "keyway") 20. For a "shake" near or proximate the end of a panel, a "false keyway" or partial keyway 22 may be cut or machined into the end, thereby giving the appearance of a "keyway" when two ends are fitted together to form a lap joint. When the keyway is a pressed-in groove, it may penetrate only the outer face of the panel, while when the keyway is a machine-cut gap, it may penetrate only the outer face or may be cut through the entire thickness of the panel (i.e., through the outer and inner face of the panel).

The dimensions of the shake panel 2 may vary, as may the number of shakes on the panel. The width of the shakes may be the same or may vary. FIG. 1 shows the visible, front face of an exemplary embodiment of a shake panel 2 with six "shakes" or "planks" 10, each with a different width. In one embodiment, the shake panel is 4.0 feet long, and 11⅞" in height. The width of the six shakes are, from left to right, 8.25", 7.25", 5.75", 9.75", 9.25" and 6.25", with a keyway length of 6" and width of ¼" inch. Each of the "false keyways" at each end of the panel is ⅛" wide, so two ends combine to form an apparent keyway of ¼" in width.

FIG. 2 shows a two plank configuration panel 4 with a single keyway 22. In one embodiment, this shake panel is 1' 4" long, and 11⅞" in height. The width of the two shakes are, from left to right, 8.25" and 7.25", with a keyway length of 6" and width of ¼", with "false keyways" at each of the panel ⅛" in width.

FIG. 3 shows a single plank configuration panel 6 with no keyways, so the plank is delineated by the respective ends of the panel, with "false" keyways 22 at the ends as described above. This shake panel is 1' 4" long, and 11⅞" in height and 8¼" in width, with false keyway dimensions as in FIGS. 1 and 2.

Figure 9:
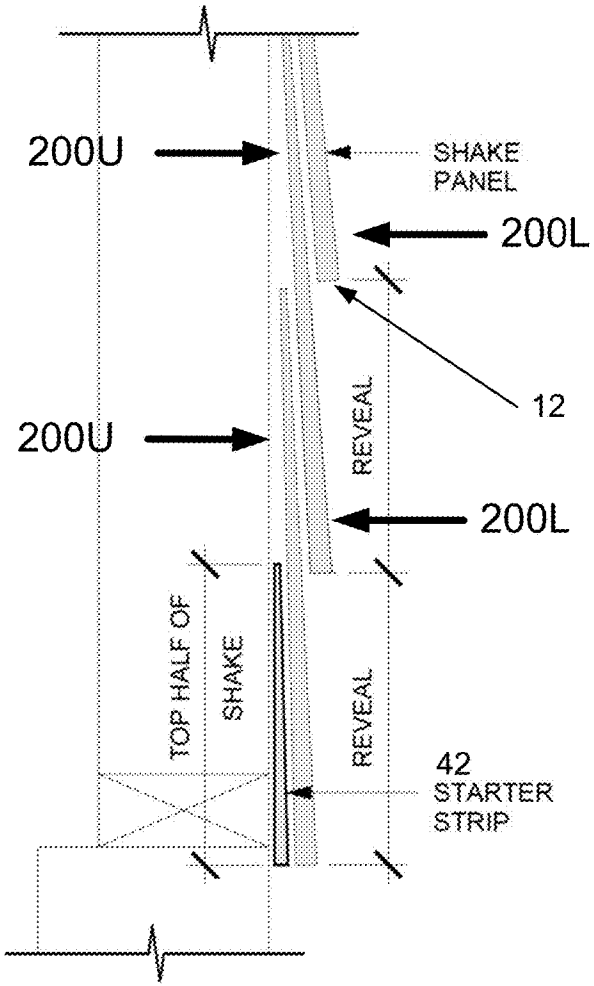
FIG. 9 shows a section view of several rows of shake panels installed on a wall.
Figures 10A, 10B, 10C:
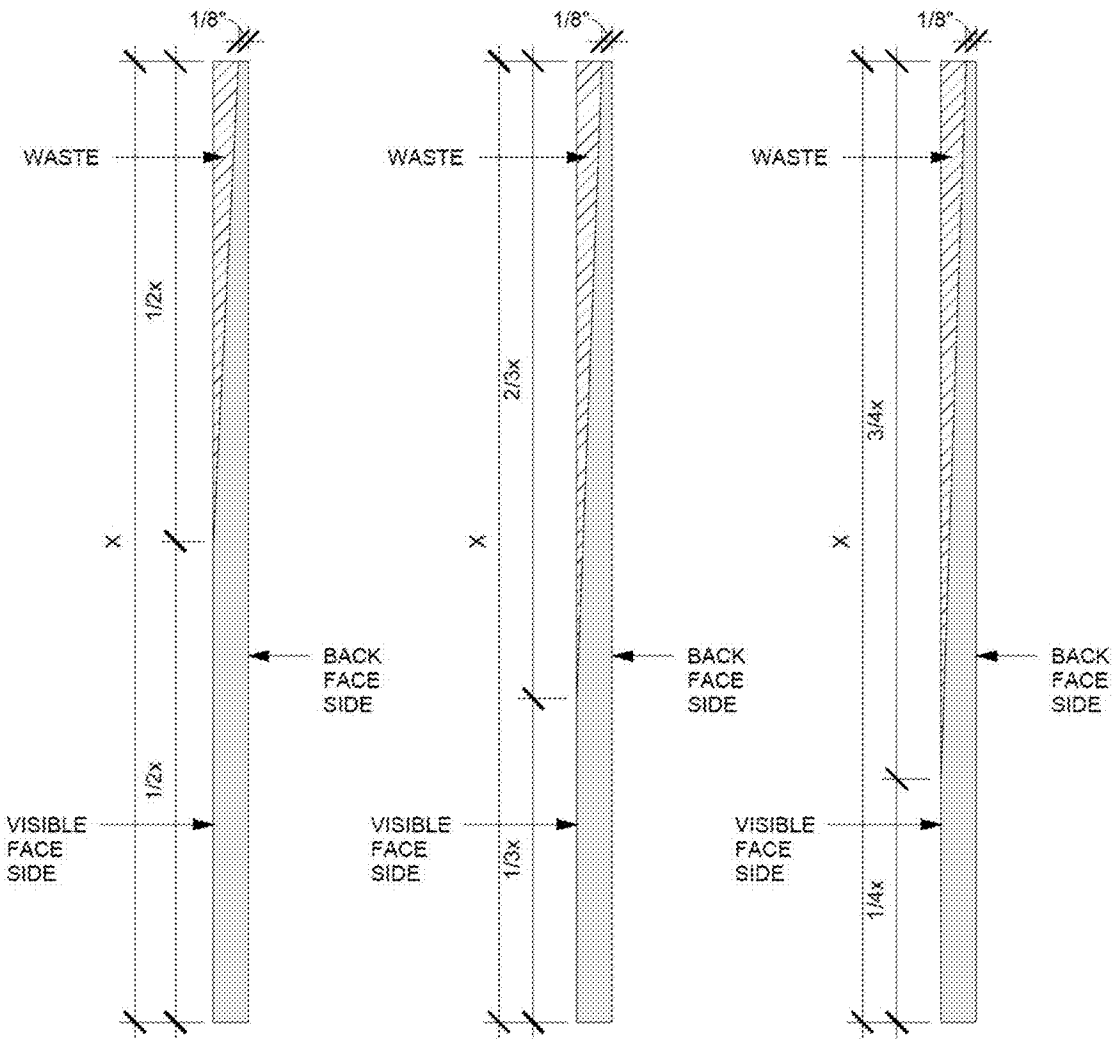
FIGS. 10A-C shows section views of a shake panel with front face tapers of different heights.
Figures 11A, 11B, 11C, 11D:
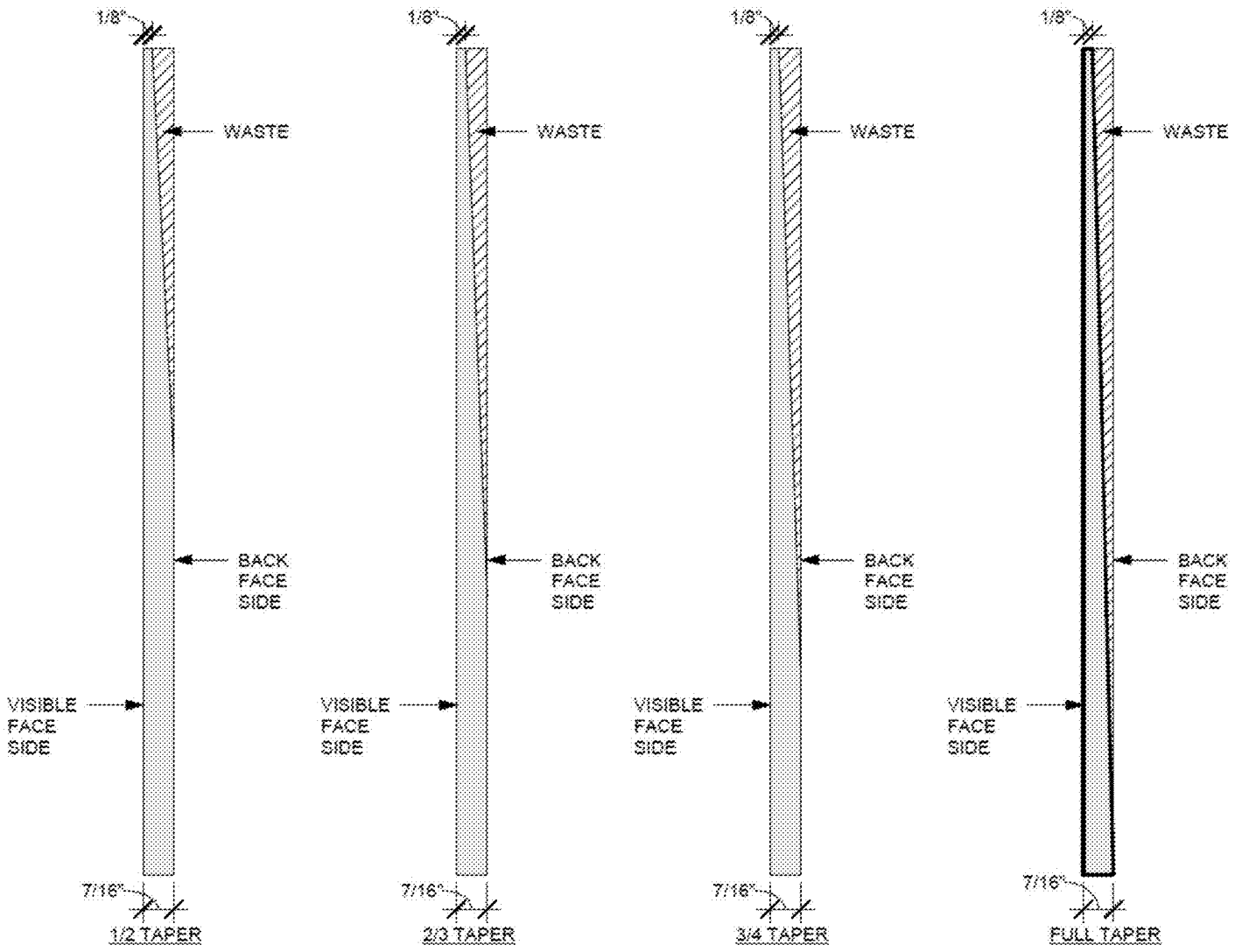
FIGS. 11A-D shows section views of a shake panel with back face tapers of different heights.

The keyways 20 generally extend from the bottom edge 12 of the panel orthogonally upward toward the top edge 14. The width of the keyway may vary based on the overall design and desired aesthetics. The length of the keyway generally extends for at least the portion of the lower part of the panel that will be exposed or revealed when the panels are installed on a wall (or roof). As seen in FIG. 9, during installation, the upper part 200U of the panels on a row are overlapped by the lower part 200L of the panels in the row immediately above, thus hiding the upper part of each row of panels when installed.

Figures 5A, 5B:
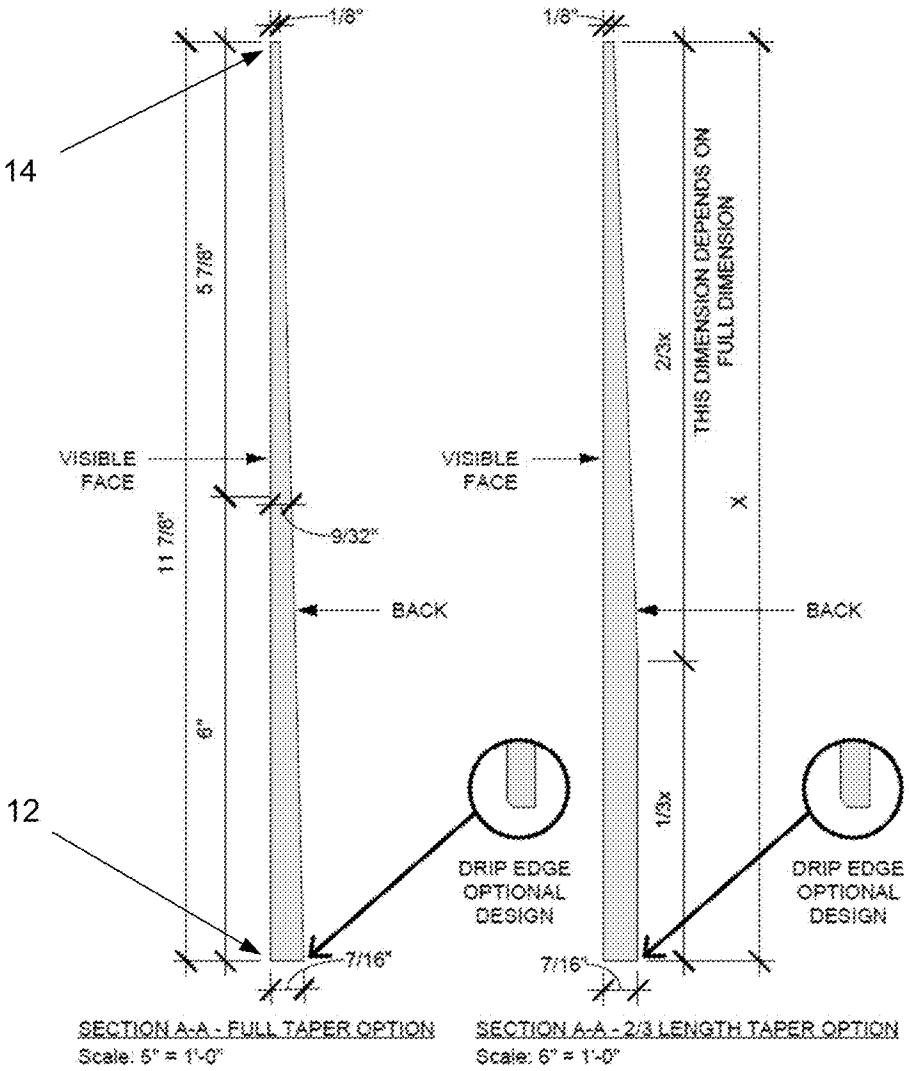
FIG. 5A shows a section view of a full-taper panel (back face taper) with bottom angled drip edge.
FIG. 5B shows a section view of a ⅔rd taper panel (back face taper) with bottom angled drip edge.
Figure 6:
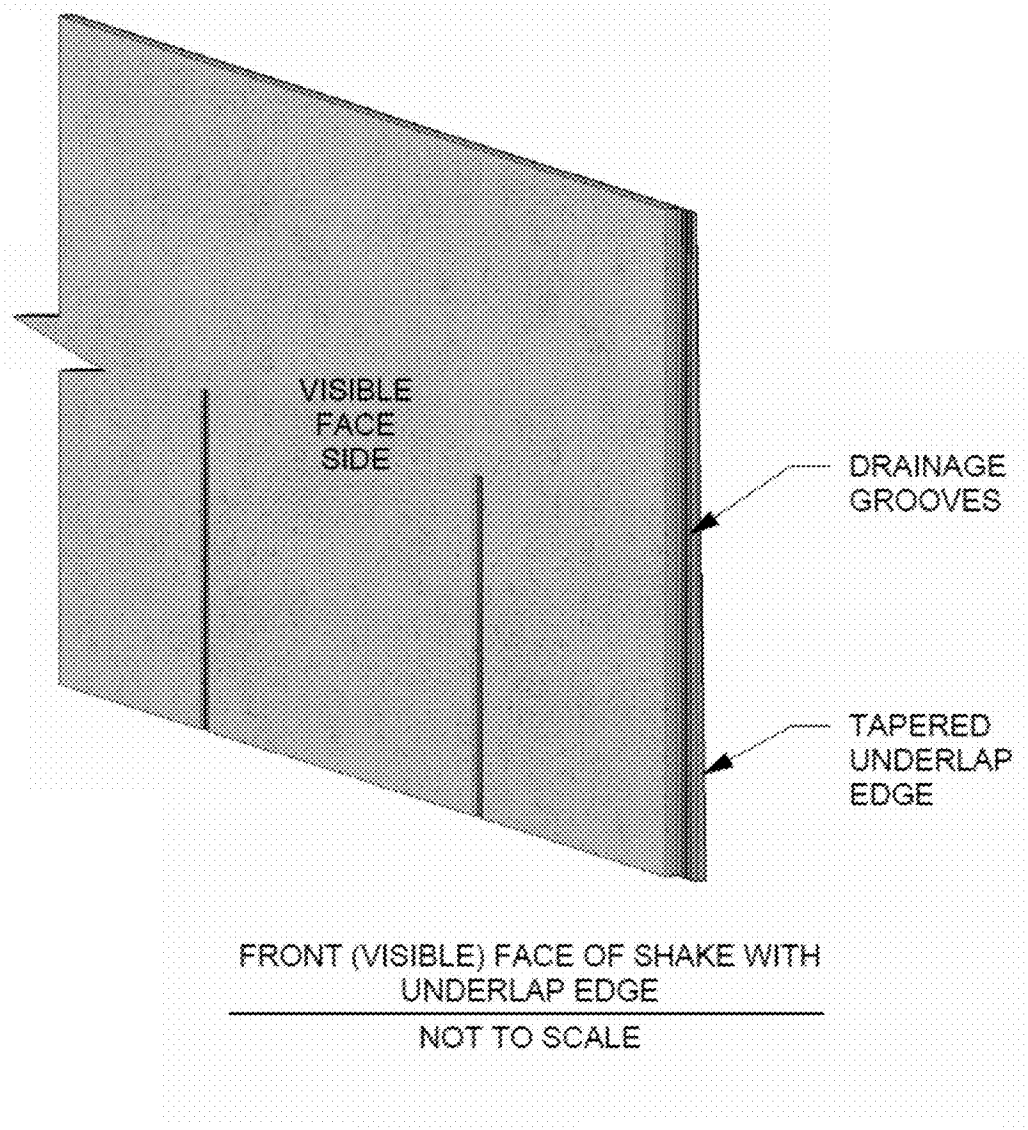
FIG. 6 shows a perspective view of the front face of the underlap end of a shake panel.
Figure 7:
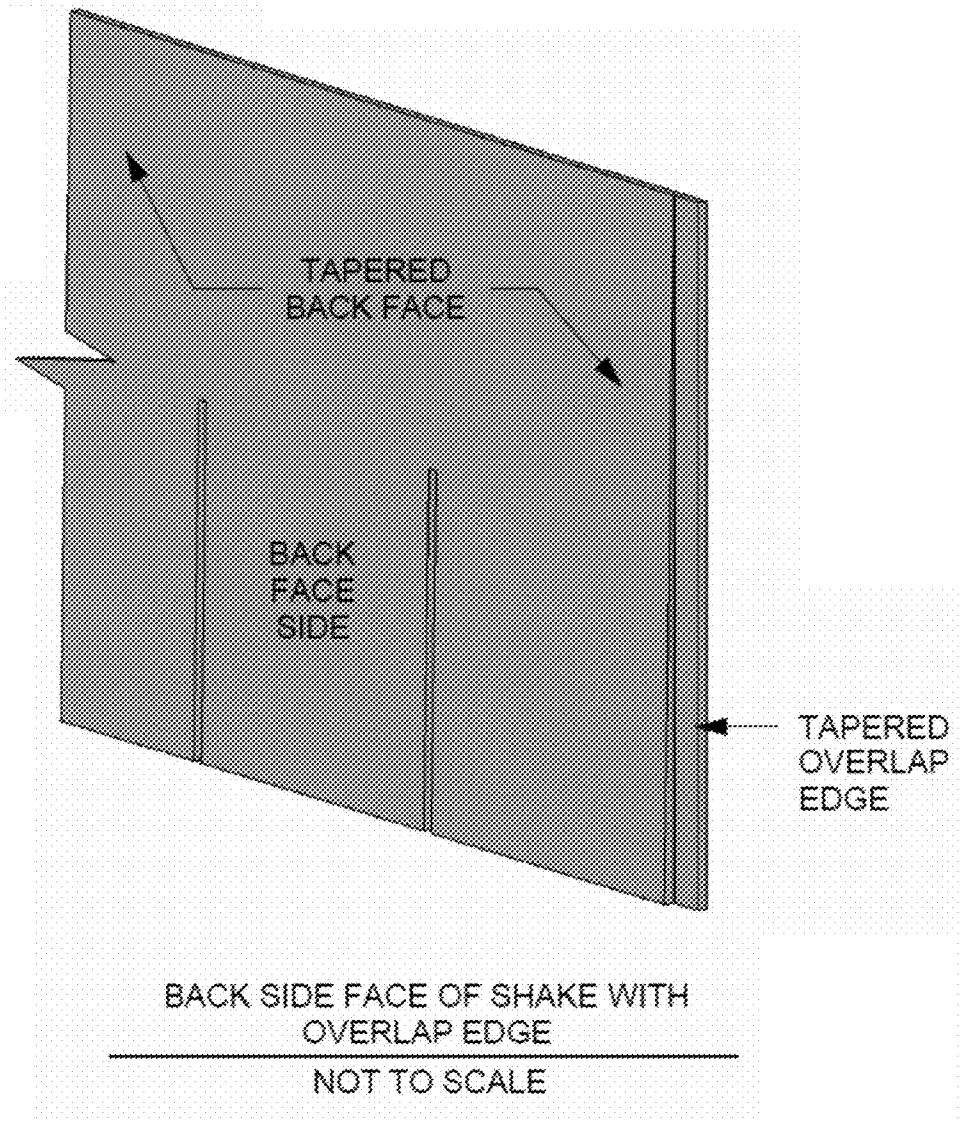
FIG. 7 shows a perspective view of the back face of the overlap end of a shake panel.

The exposed bottom edge or end 12 of the shake panel, commonly referred to as the drip edge, may vary in configuration (e.g., traditional square cut, rounded, triangular, angled, or the like), depending on the aesthetics and performance required. The bottom edge 12 profile may be a butt-end (i.e., square, right-angle to the shake face), rounded, or angled, as seen in FIGS. 5A and 5B. In several embodiments, the bottom edge may be angled or shaped to promote water droplet drop-off, run-off, or "shedding" from the panel, by preventing or reducing the ability of a water droplet to "cling" to the bottom drip edge, and from moving towards the back face of the panel through capillary or similar action. For example, a shallow kerf cut may be machined into and parallel to the drip edge on the back side of the shake to stop any capillary action or movement of water.

Figure 4:
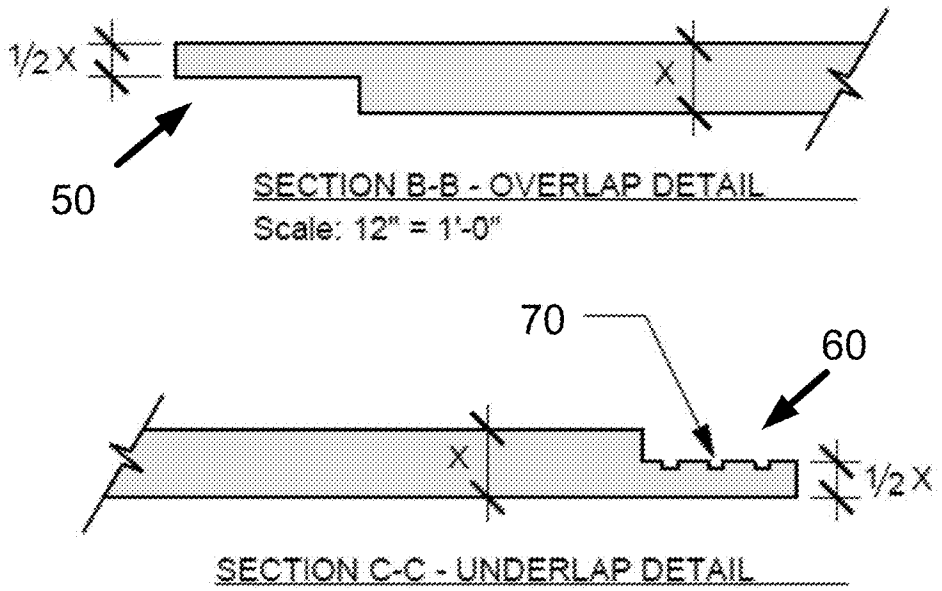
FIG. 4 shows a detailed view of the overlap and underlap ends of a panel.

FIG. 4 shows a detail cross-section of the overlap 50 and underlap 60 ends of the panel, which together form a shiplap joint. While the figure shows the relative thickness of the overlap section and underlap section at the same distance from the bottom of the panel as each being one-half the thickness of the panel, the relative thickness may vary (i.e., the overlap portion may be thicker or thinner than the underlap portion). In general, as the panel thickness will vary if the panel is tapered, as described below, the thicknesses of the underlap portion and overlap portion will vary proportionately.

While a panel 2 may be of uniform thickness, in preferred embodiments the panel is tapered (i.e., wedge-like) in cross-section, with the top portion of the panel being thinner than the bottom portion, as seen in FIGS. 5A and 5B. The taper may extend for some or all of the height of the panel (e.g., one-quarter, one-third, one-half, two-thirds, three-quarters, or the full height). As seen in FIGS. 5A, 5B, and 10A-11D ("waste" in the figures indicates the removed portion of the panel that is machined or cut away from the front/visible face, see FIGS. 10A-C, or the back face, see FIGS. 11A-D). The taper height and angle of cut would vary depending on the design and desired aesthetics.

The taper may be cut or machined into the panel during a secondary manufacturing process. The taper may be machined or cut onto the front face (i.e., outer or visible face) and/or the back face. In embodiments where a full-height taper is desired, the taper is machined on the back face. Similarly, in embodiments where the taper would be visible on the front face after installation, the taper preferably would be machined on the back face, as seen in FIGS. 5A, 5B, 6 and 7. The back face taper cut is important to preserve visible face surfaces that have aesthetic textures (e.g., wood grain), and also allows the installer to vary the overlap of shakes to achieve a desired aesthetic effect. The installer can also alternate the overlap to achieve a staggered look.

Figure 8:
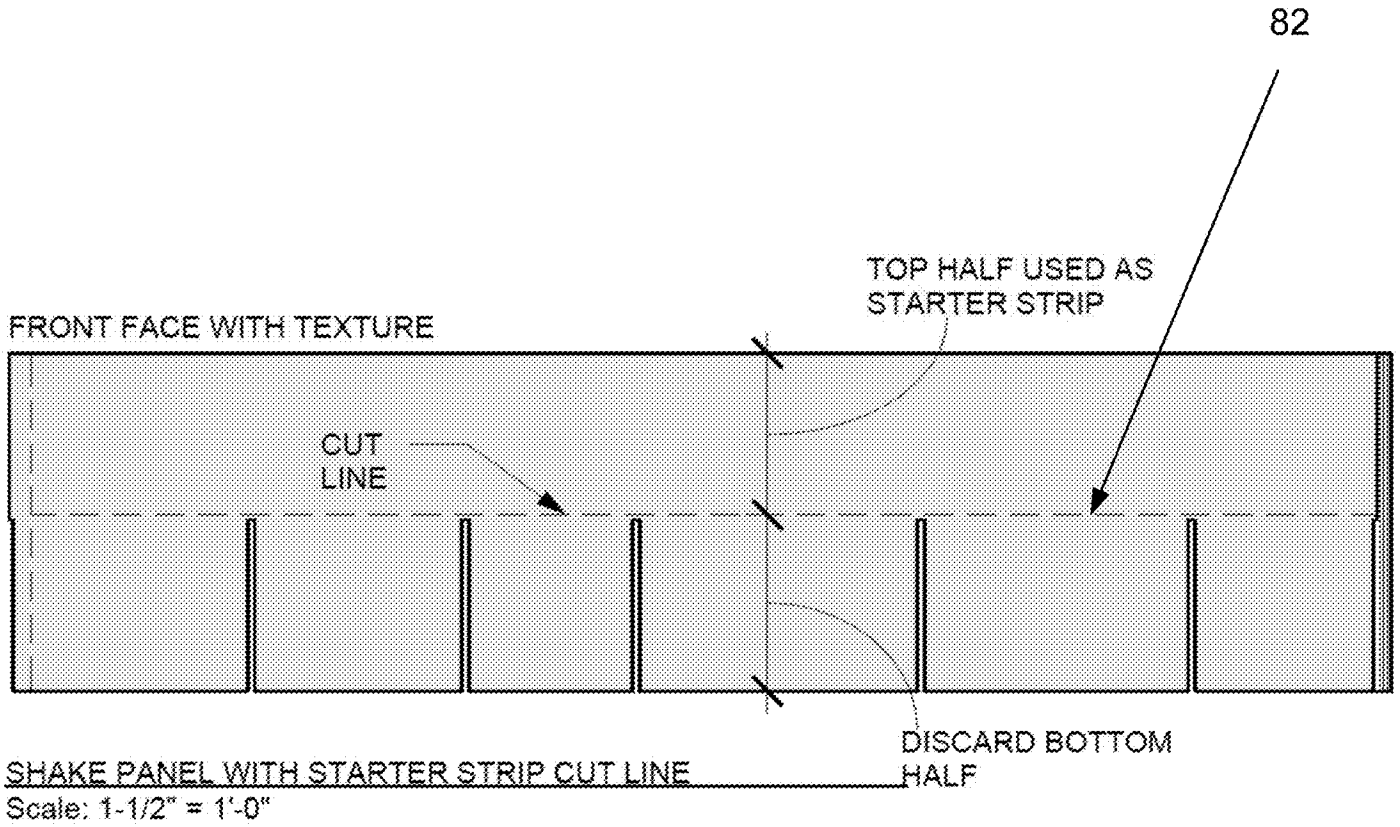
FIG. 8 shows a front view of the front face of a shake panel with a starter strip cut line.

FIG. 9 shows sequential rows or courses of engineered-wood shake panels, tapered, with ship-lapped ends, and with fully-machined grooves installed on a wall. A first (starter strip) 42 course is first installed as the bottommost row, and then covered by the subsequent courses to create a weathertight or weather resistant joint at the keyways (the joint at the ends is weathertight or weather resistant due to the shiplap joint overlap). The starter strip places the second course at the correct angle off the wall, and covers or plugs the keyway hole (if the keyway if fully cut through), thereby preventing moisture intrusion behind the siding or cladding. FIG. 8 shows a panel with a starter strip cut line 82: the installer cuts the panel along the starter strip cut line, and uses the top half as the starter strip. This ensures that the starter strip is configured to fit below the bottom part of the panels in the course immediately above.

Accordingly, the present invention solves the problem of wood shakes used in the prior art not laying flat on a wall or other surface, thus presenting an objectionable appearance, by inclusion of a taper on the engineered-wood composite shake or shingle as described above. It also solves the problem of moisture intrusion at the end joints by use of a ship-lapped end joint, which prevents moisture from penetrating the end joint.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An engineered wood shake siding panel, comprising:

an engineered-wood board with a front face, a back face, a top edge, a bottom edge, a thickness, a first end comprising a shiplap joint overlap section and a second end comprising a shiplap joint underlap section;

two or more shakes on the front face, with at least one keyway extending upward from the bottom edge between adjacent shakes;

a first partial keyway extending upward from the bottom edge along the first end; and a second partial keyway extending upward from the bottom edge along the second end;

wherein the thickness of the engineered-wood board tapers towards the top edge for at least half the distance between the bottom edge and the top edge.

2. The shake siding panel of claim 1, wherein the at least one keyway is a groove pressed or cut into the front face and does not penetrate the back face.

3. The shake siding panel of claim 1, wherein the at least one keyway is a groove cut into the front face and through the back face.

4. The shake siding panel of claim 1, wherein there are three shakes and two keyways.

5. The shake siding panel of claim 1, wherein the engineered-wood board has a thickness that tapers.

6. The shake siding panel of claim 5, wherein the thickness of a top portion of the engineered-wood board is thinner than a bottom portion of the engineered-wood board.

7. The shake siding panel of claim 6, wherein the taper extends for the full height of the engineered-wood board.

8. The shake siding panel of claim 6, wherein the taper extends for a part of the height of the engineered-wood board.

9. The shake siding panel of claim 6, wherein the taper extends linearly.

10. The shake siding panel of claim 6, wherein the top edge has a ⅛" thickness at the taper.

11. The shake siding panel of claim 5, wherein the taper is cut into the back face.

12. The shake siding panel of claim 5, wherein the taper is cut into the front face.

13. The shake siding panel of claim 1, wherein the engineered wood is oriented-strand board.

14. The shake siding panel of claim 1, further comprising a starter strip cut line extending from the first end to the second end.

15. A siding system, comprising:

a plurality of engineered wood shake siding panels according to claim 1;

wherein the engineered wood shake siding panels are configured to be installed end-to-end in sequential rows or courses on a wall, with subsequent upper courses partially overlaying lower courses, and with keyways on the lower courses extending upward to at least the bottom edge of the upper courses;

wherein the first end and second end of adjacent siding panels on a row or course are configured to form a weathertight shiplap joint, with the corresponding first partial keyway and the second partial keyway meeting to form the appearance of a single keyway.

16. The siding system of claim 15, further wherein each of the plurality of engineered wood shake siding panels are tapered in thickness, such that the top edge is thinner than the bottom edge.

17. The siding system of claim 16, wherein the taper of the siding panels on a row or course is fully covered.

18. The siding system of claim 15, wherein the engineered wood is oriented-strand board.

19. The siding system of claim 15, wherein a lower portion of the front face of the siding panels on a row or course is exposed.

* * * * *